US007055477B2

(12) United States Patent
Todo et al.

(10) Patent No.: US 7,055,477 B2
(45) Date of Patent: Jun. 6, 2006

(54) VALVE ACTUATION APPARATUS FOR INTERNAL COMBUSTION ENGINE AND METHOD OF ADJUSTING LIFT THEREOF

(75) Inventors: Tamotsu Todo, Kanagawa (JP); Yoshihiko Yamada, Kanagawa (JP); Yusuke Takagi, Yokohama (JP)

(73) Assignees: Hitachi, Ltd., Tokyo (JP); Nissan Motor Co., Ltd., Yokoham (JP)

( * ) Notice: Subject to any disclaimer, the term of this patent is extended or adjusted under 35 U.S.C. 154(b) by 0 days.

(21) Appl. No.: 10/899,074

(22) Filed: Jul. 27, 2004

(65) Prior Publication Data

US 2005/0028769 A1 Feb. 10, 2005

(30) Foreign Application Priority Data

Aug. 5, 2003 (JP) ..... 2003-205949

(51) Int. Cl.
*F01L 1/34* (2006.01)

(52) U.S. Cl. ..... 123/90.16; 123/90.15; 123/90.17; 123/90.31; 74/568 R; 74/569

(58) Field of Classification Search ..... 123/90.16
See application file for complete search history.

(56) References Cited

U.S. PATENT DOCUMENTS 4,627,391 A * 12/1986 Derringer ..... 123/90.16
6,499,454 B1 * 12/2002 Miyazato et al. ..... 123/90.31
6,691,655 B1 * 2/2004 Aoyama et al. ..... 123/90.16

FOREIGN PATENT DOCUMENTS

JP 2001-123809 A 5/2001

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A VA apparatus includes a rocker arm coaxially swingably supported on a support shaft. The rocker arm is swung by torque transmitted from an engine to operate an engine valve and includes a first arm to which torque is transmitted and a second arm for operating the engine valve. The first and second arms, which are separate and distinct from each other, are swingable relative to each other. Bolts are provided to fix the first and second arms in a predetermined relative angle position.

19 Claims, 8 Drawing Sheets

VALVE ACTUATION APPARATUS FOR INTERNAL COMBUSTION ENGINE AND METHOD OF ADJUSTING LIFT THEREOF

BACKGROUND OF THE INVENTION

The present invention relates to a valve actuation (VA) apparatus for an internal combustion engine, and more particularly, to a VA apparatus constructed to adjust the lift of an engine valve to an appropriate amount.

Typically, the VA apparatus, adapted to intake valves as an engine valve, includes: (a) a driving shaft that rotates in synchronism with rotation of a crankshaft, (b) a crank cam that is arranged at the outer periphery of the driving shaft and that has an axis eccentric with an axis of the driving shaft, and (c) a valve operating (VO) cam that receives torque of the crank cam through a transmission mechanism of multi-node linkage and that opens the intake valve against a biasing force of a valve spring by slide contact of a cam face with the top face of a valve lifter arranged at the upper end of the intake valve.

The transmission mechanism includes: (a) a rocker arm that is disposed above the VO cam and that is swingably supported on a control shaft, (b) a crank arm that has one end of circular shape engaged on the outer peripheral surface of the crank cam and another end rotatably coupled to a first arm of the rocker arm through a pin, and (c) a link rod that has a first end rotatably coupled to a second arm of the rocker arm through a pin and a second end rotatably coupled to a cam nose of the VO cam through a pin.

The control shaft is rotatably supported on a bearing disposed at the upper end of a cylinder head. Fixed on the outer peripheral surface of the control shaft is a control cam that has an axis offset with respect to an axis of the control shaft by a predetermined amount; the rocker arm is swingably supported on the outer periphery of the control cam.

In accordance with the engine operating conditions, an actuator, which includes an electric motor and screw transmission means, changes a rotated position of the control cam through the control shaft to vary a rocking fulcrum of the rocker arm, thereby achieving variable control of the lift of the intake valve.

The VO apparatus requires a number of component parts such as transmission mechanism of multi-node linkage. Due to their manufacturing and assembling errors, there often occurs a variation in lift of the intake valve, particularly, variations in valve lift between cylinders.

Therefore, after mounting the component parts to the driving shaft and the control shaft on the cylinder head with the valve spring operated radially, the lift of the intake valve is adjusted by replacing the link rod with another link rod of different length or changing a pivotal point of the link rod and the rocker arm.

However, with adjustment of the valve lift by replacing the link rod, the valve lift is measured with the link rod coupled to the rocker arm or the VO cam. And if a variation in valve lift is produced, the link rod is replaced with another once again. Thus, adjustment requires complicated work, leading to lowering of the efficiency of adjusting work. Moreover, reassemblage of the link rod may cause an assembling error.

On the other hand, with adjustment of the valve lift by changing a pivotal point of the link rod and the rocker arm, a great variation in valve lift is difficult to absorb due to limitation of change in pivotal point.

SUMMARY

An object of the present invention to provide a VA apparatus for an internal combustion engine, which allows easy adjustment of the lift of an engine valve. Another object of the present invention is to provide a method of adjusting the lift of the engine valve in the VA apparatus.

The present invention provides generally a VA apparatus for an internal combustion engine, which comprises: a shaft; a rocker arm coaxially swingably supported on the shaft, the rocker arm being swung by a torque transmitted from the engine to operate an engine valve, the rocker arm comprising a first arm to which the torque is transmitted and a second arm for operating the engine valve, the first and second arms being separate and distinct from each other, the first and second arms being swingable relative to each other; and a fixing device which fixes the first and second arms in a predetermined relative angle position.

Another aspect of the present invention lies in providing a method of adjusting a lift of a VA apparatus comprising a rocker arm swung by a torque transmitted from the engine to operate an engine valve, the rocker arm comprising a first arm to which the torque is transmitted and a second arm for operating the engine valve, the first and second arms being separate and distinct from each other, the first and second arms being swingable relative to each other, and a fixing device which fixes the first and second arms in a predetermined relative angle position, wherein the method comprises: determining a relative reference angle position of the first and second arms by a reference setting member for defining a relative reference position of the first and second arms; fixing temporarily the first and second arms by the fixing device; measuring a difference in lift of the engine valve between cylinders with the first and second arms fixed; selecting, in accordance with the measured difference, an adjusting member for adjusting the difference to an optimum value; interposing the adjusting member between the reference setting member and one of the first and second arms with fixing of the first and second arms by the fixing device released; and fixing definitively the first and second arms by the fixing device with the adjusting member interposed between the reference setting member and one of the first and second arms.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
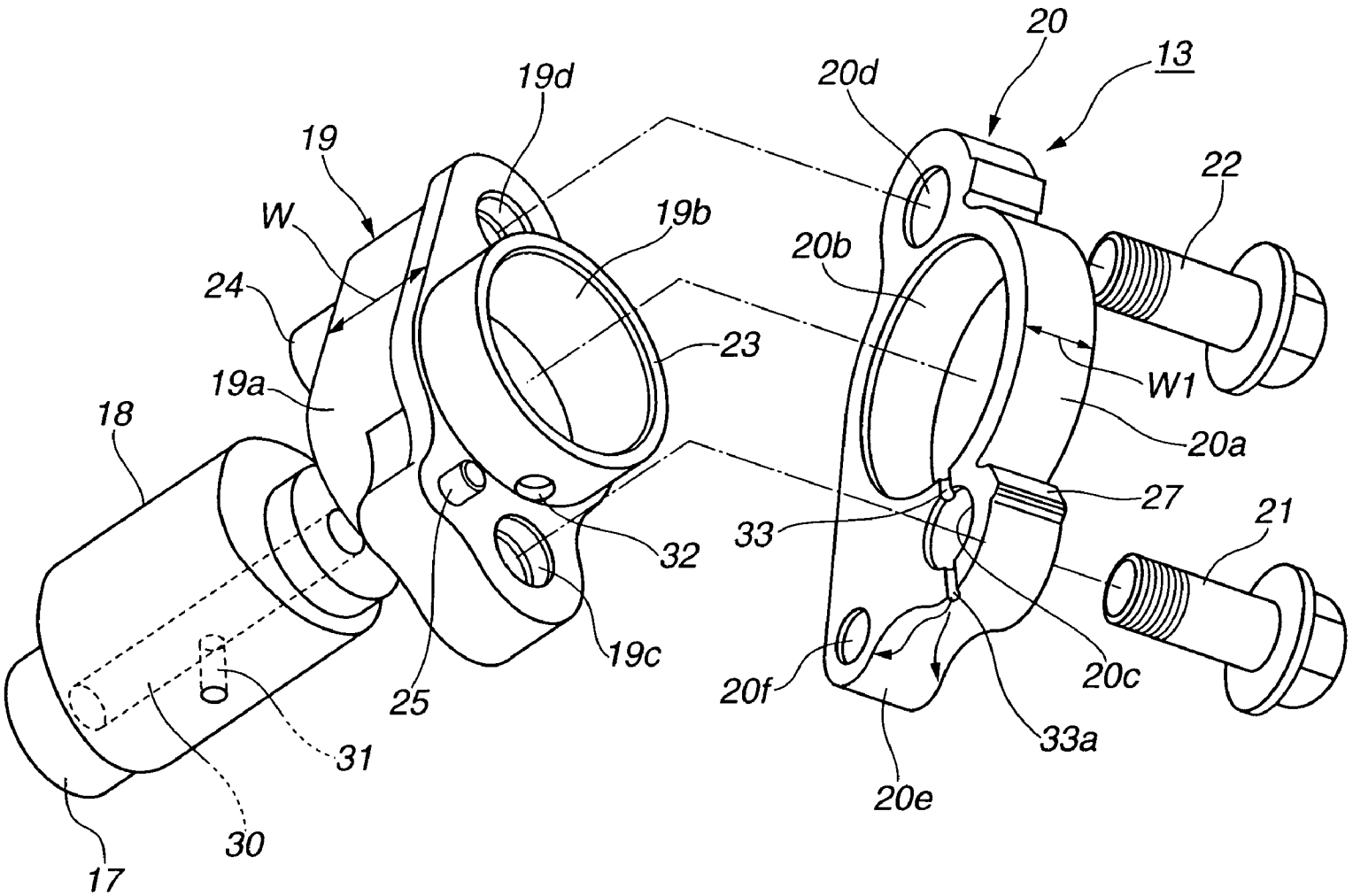
FIG. 1 is an exploded perspective view showing a rocker arm of a VA apparatus embodying the present invention.

Referring to the drawings, a description is made about a VA apparatus for an internal combustion engine embodying the present invention. In the illustrative embodiments, the VA apparatus is applied to an internal combustion engine including two intake valves per cylinder, the valve lift of each being varied in accordance with the engine operating conditions.

With respect to FIGS. 1–5, there is shown first embodiment of the present invention. In particular, with respect to FIGS. 2 and 3, the VA apparatus includes: (a) a pair of intake valves 2 slidably that are provided to a cylinder head 1 through valve guides, not shown, (b) a hollow driving shaft 3 that is disposed in the engine longitudinal direction, (c) a camshaft 4 that is rotatably coaxially supported on the outer peripheral surface of driving shaft 3, (d) a crank cam 5 that is fixed to driving shaft 3 at a predetermined position, (e) a pair of VO cams 7 that are integrated with camshaft 4 at both ends and that open intake valves 2 by slide contact with valve lifters 6, which are arranged at the upper ends of intake valves 2, (f) a transmission mechanism 8 that is linked between crank cam 5 and VO cams 7 and that transmits torque of crank cam 5 to VO cams 7 as their swinging force or valve opening force, and (g) a control mechanism 9 for varying the operating position of transmission mechanism 8.

Driving shaft 3, which is disposed in the engine longitudinal direction, has both ends rotatably supported on a bearing, not shown, that is arranged in an upper portion of cylinder head 1. Driving shaft 3 receives torque from a crankshaft of the engine through a driven sprocket, not shown, arranged at one end, a timing chain wound thereon, and the like.

Camshaft 4, which is shaped roughly cylindrically along the axial direction of driving shaft 3, has a hole formed therethrough to extend axially; the camshaft 4 is rotatably engaged on the outer peripheral surface of driving shaft 3. A large-diameter cylindrical journal 4*a* formed at the center position is rotatably supported on a cam bearing 11.

Crank cam 5 is shaped roughly like a disc, and has one side with which a fixing cylindrical portion 5*a* is integrated. Cylindrical portion 5*a*, which is integrally fixed on the outer periphery of driving shaft 3 at a predetermined axial position through a fixing pin 12, has an outer peripheral surface that is formed with a cam profile of an eccentric circle to have an axis Y offset with respect to an axis X of driving shaft 3 in the radial direction by a predetermined amount.

VO cams 7 are both shaped roughly like a raindrop, and have a base end constructed to swing about axis X of driving shaft 3 through camshaft 4 and a cam face 7*a* formed on the underside. Cam face 7*a* includes a base-circle face on the side of the base end, a ramp face circularly extending from the base-circle face to a cam nose 7*b*, and a lift face extending from the ramp face to a top face of maximum lift arranged at the front end of cam nose 7*b*. The base-circle face, ramp face, lift face, and top face make contact with the top face of valve lifter 6 at predetermined points in accordance with the swinging position of VO cam 7.

Figure 2:
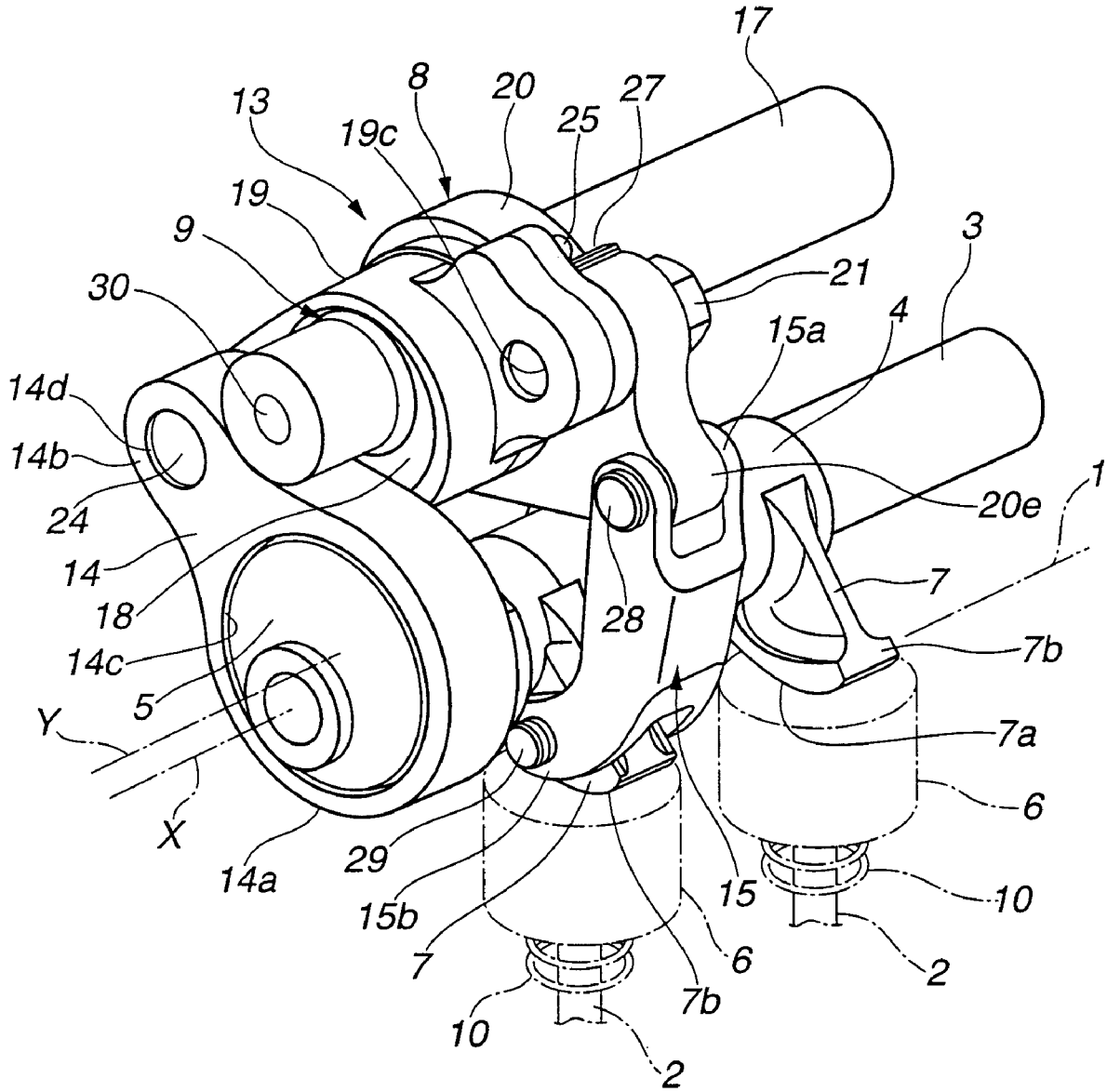
FIG. 2 is a perspective view showing the VA apparatus.

A pin hole is formed through cam nose 7*b* of left VO cam 7 as viewed in FIG. 2, through which a pin 29 is arranged to couple cam nose 7*b* and a second end 15*b* of a link rod 15.

Transmission mechanism 8 includes: (a) a rocker arm 13 that is disposed above driving shaft 3, (b) a crank arm 14 for linking one end of rocker arm 13 to crank cam 5, and (c) the link rod 15 for linking another end of rocker arm 13 to a cam nose 7*b* of left VO cam 7.

With respect to FIGS. 1–4, rocker arm 13 is divided into two portions in the axial direction of a control shaft 17 to include: (a) a first arm 19 that is linked to crank arm 14 and (b) a second arm 20 that is linked to link rod 15. First and second arms 19, 20 are relatively swingably supported on a control cam 18 arranged on the outer periphery of control shaft 17 as a support shaft, and are coupled together by two bolts or fixing means 21, 22 to have a predetermined relative opening-angle position.

Specifically, first arm 19 is shaped roughly like a rhombus, and includes a cylindrical base 19*a* having a support hole 19*b* formed therethrough. Control cam 18 is arranged through support hole 19*b* to have the outer peripheral surface slidably supported therein. A cylindrical protrusion 23 is arranged to protrude axially from the edge of support hole 19*b* and have an axis coaxial with an axis of control cam 18. Bolt holes 19*c*, 19*d* are formed at both ends of first arm 19 to engage with bolts 21, 22. An axis pin 24 is integrated with one end of first arm 19 to be linked to crank arm 14.

A reference pin or reference setting member 25 is arranged to protrude from the face of first arm 19 on the side of protrusion 23, thereby defining a reference position of the relative swinging angle between first and second arms 19, 20, i.e. a reference lift of intake valves 2.

On the other hand, second arm 20 has a center portion 20*a* through which an engagement hole or engagement portion 20*b* is formed; the engagement hole 20*b* is engaged with protrusion 23 to make first and second arms 19, 20 swingable about control cam 18. Bolt holes 20*c*, 20*d* are formed at both ends of second arm 20 to engage with bolts 21, 22. Each bolt hole 20*c*, 20*d* has an inner diameter sufficiently larger than an outer periphery of the shank of bolt 21, 22 to allow relative oscillation of first and second arms 19, 20 through a clearance between bolt hole 20*c*, 20*d* and the shank of bolt 21, 22.

A swelling 20*e*, which is arranged at another end of second arm 20, has a pin hole 20*f* that receives a pin 28 linked to a first end 15*a* of link rod 15. A contact face 27 is formed with one side of center portion 20*a* to make contact with the side edge of reference pin 25 at a maximum relative opening-angle position of first and second arms 19, 20. Contact face 27 has an outer side edge formed in an inclined way.

As shown in FIG. 1, first arm 19 has a width W sufficiently larger than a width W1 of second arm 20.

Figure 3:
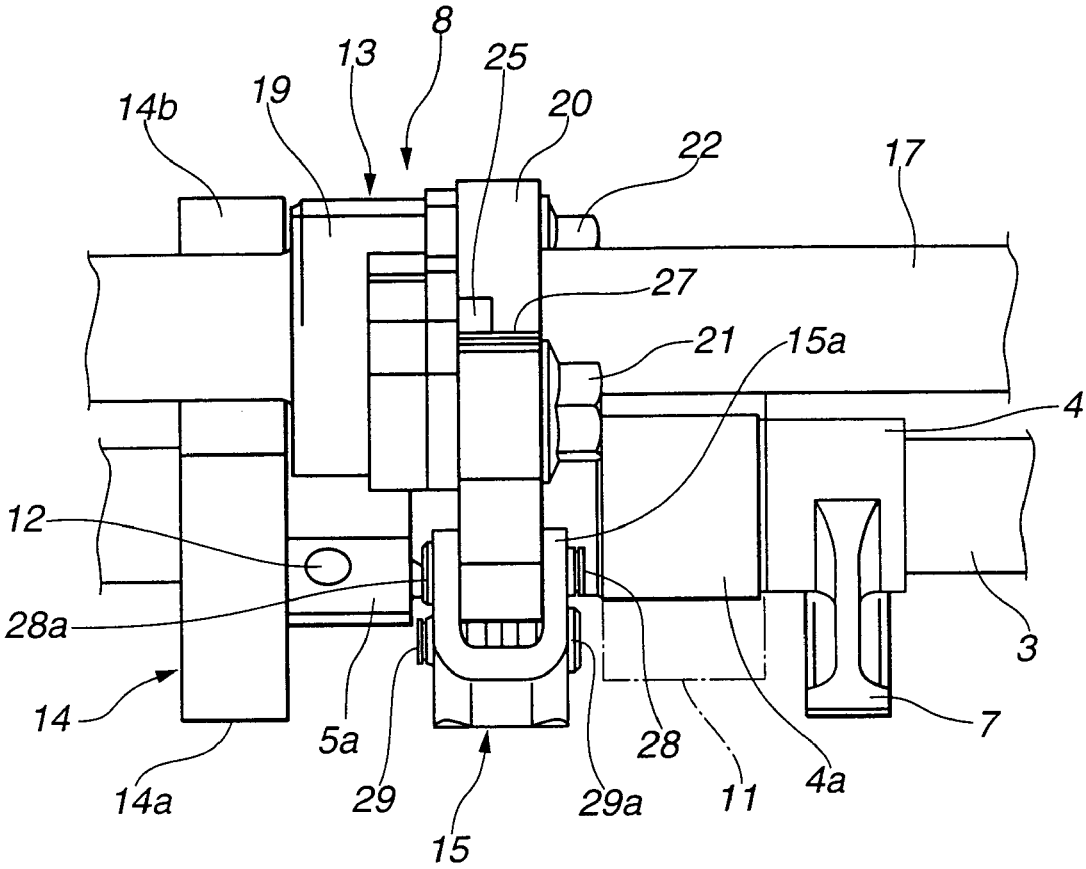
FIG. 3 is a plan view showing the VA apparatus.
Figure 4:
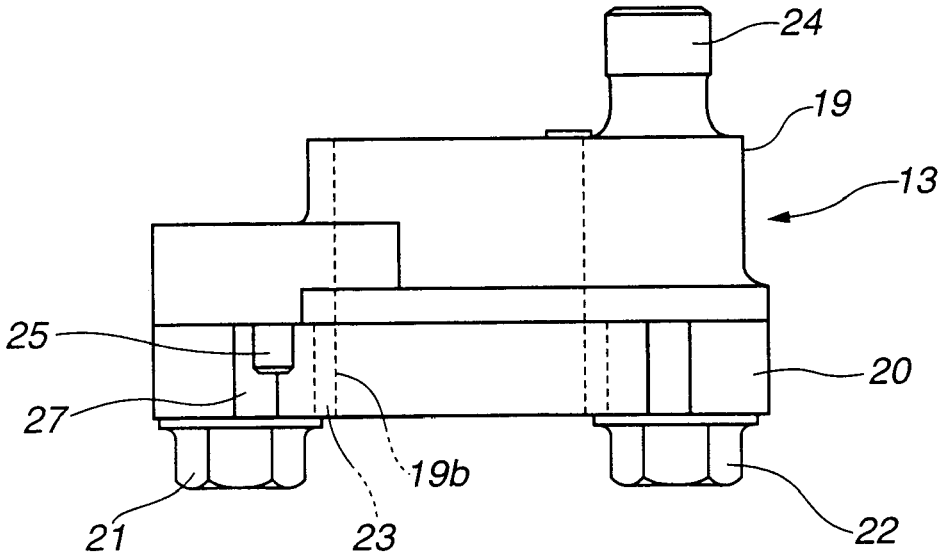
FIG. 4 is a view similar to FIG. 3, showing the rocker arm.
Figure 5:
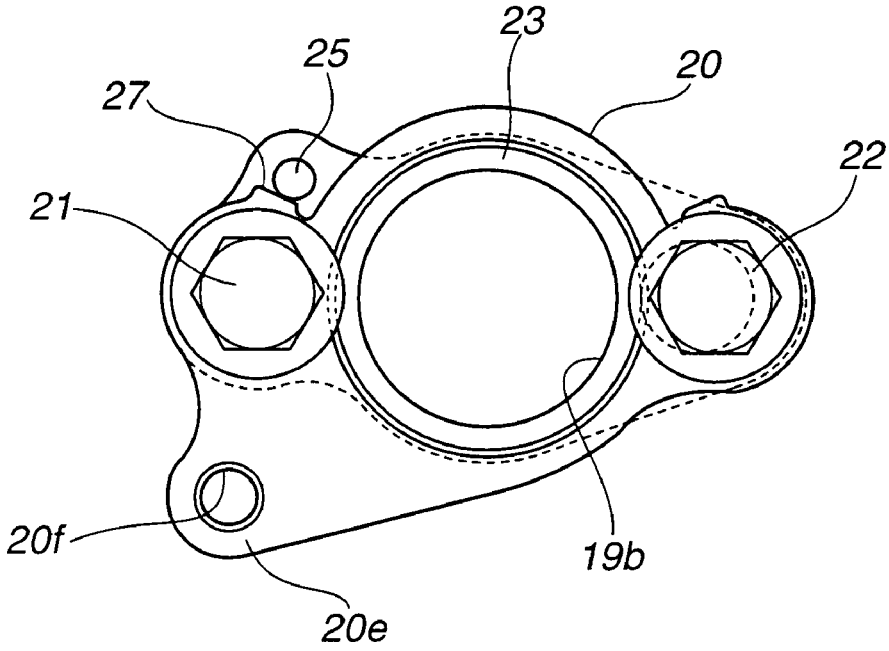
FIG. 5 is a front view showing the rocker arm.
Figure 6:
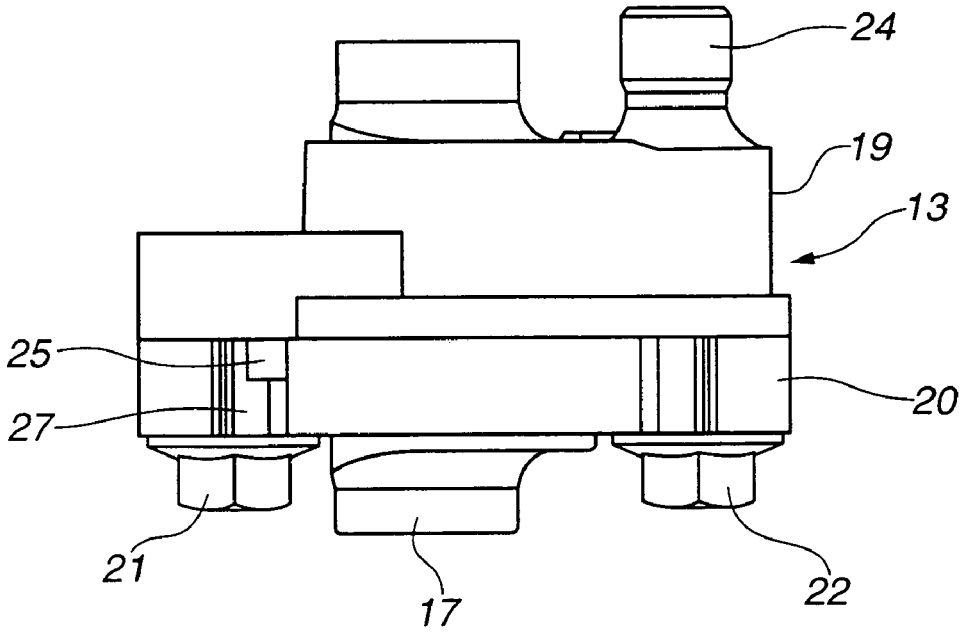
FIG. 6 is a view similar to FIG. 4, showing a second embodiment of the present invention.
Figure 7:
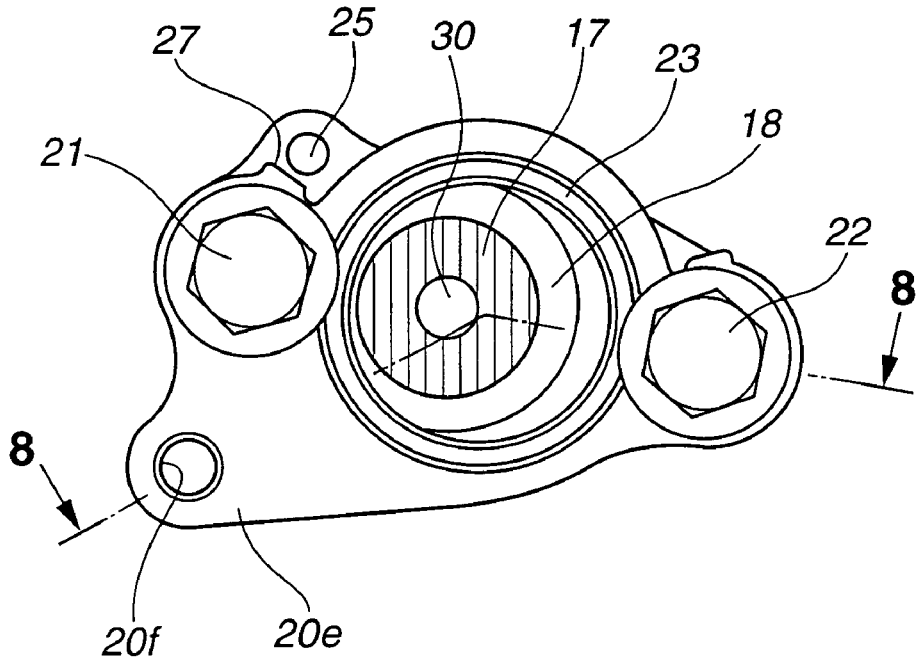
FIG. 7 is a view similar to FIG. 5, showing the rocker arm in FIG. 6.
Figure 8:
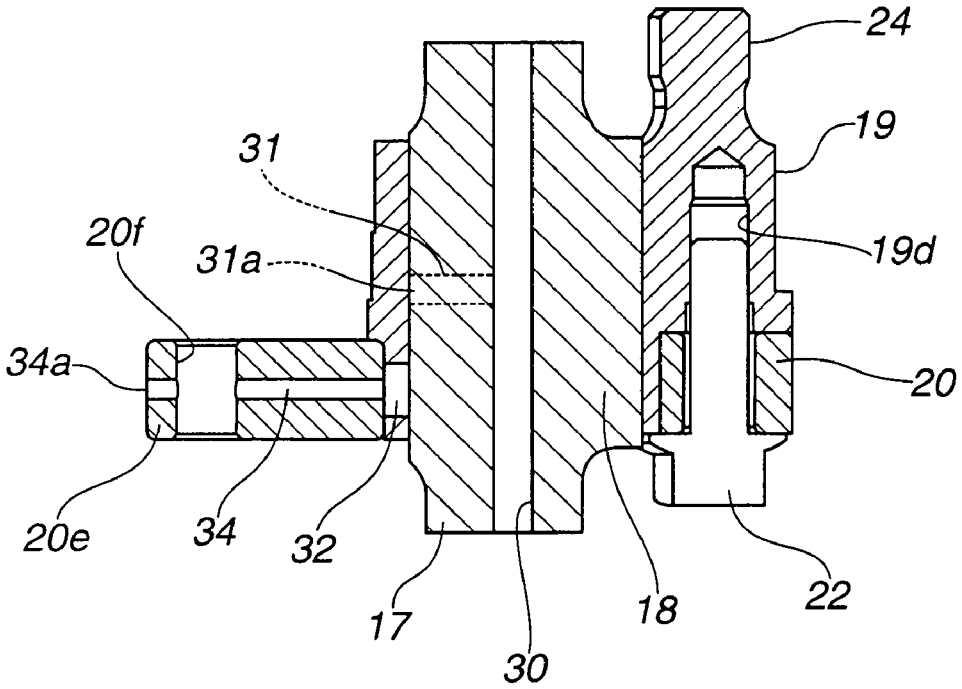
FIG. 8 is a sectional view taken along the line 8—8 in FIG. 7.
Figure 9:
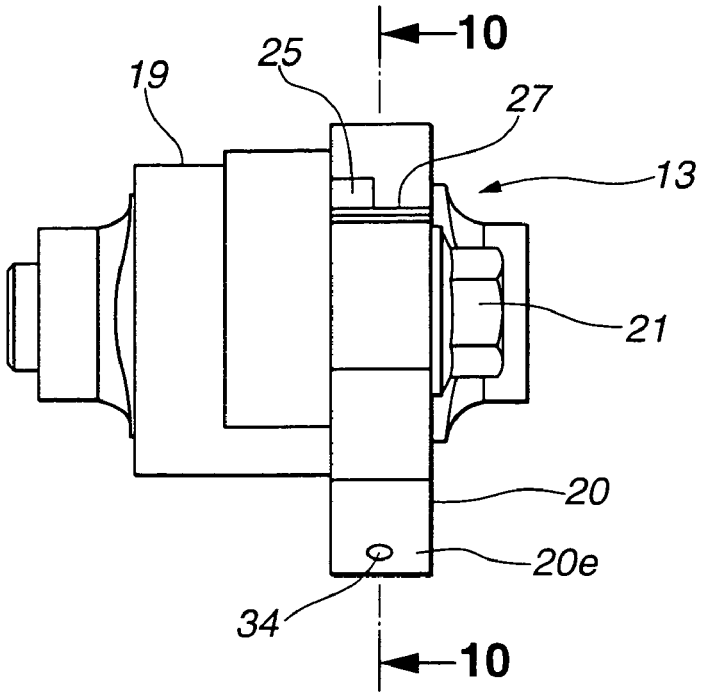
FIG. 9 is a side view of the rocker arm in FIG. 6.
Figure 10:
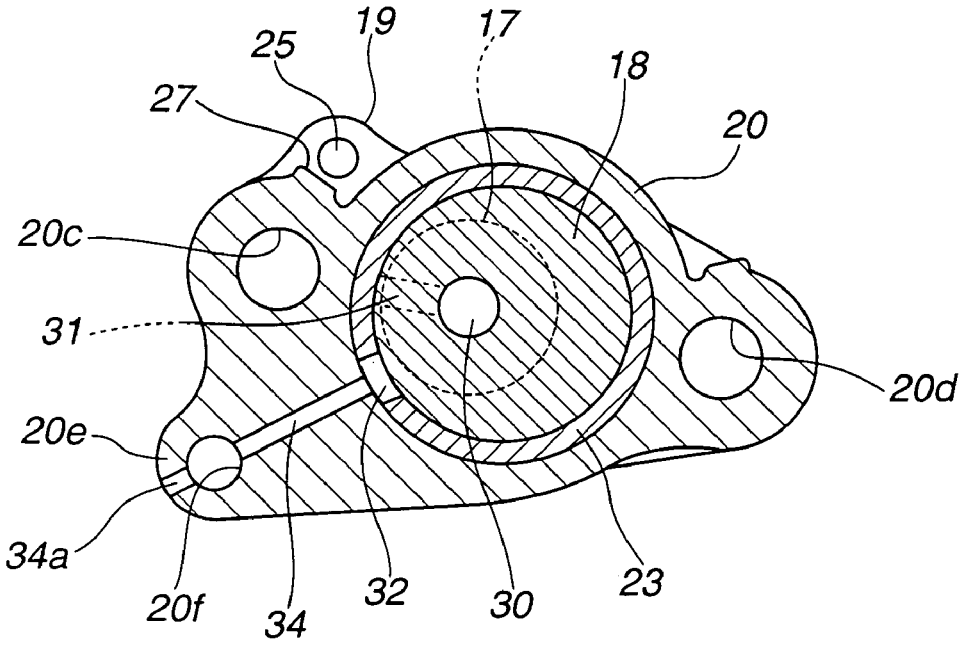
FIG. 10 is a view similar to FIG. 8, taken along the line 10—10 in FIG. 9.

With respect to FIGS. 2 and 3, crank arm 14 includes: (a) a relatively-large-diameter circular portion 14*a* and (b) an extension 14*b* formed with circular portion 14*a* to protrude from a predetermined position of the outer peripheral surface thereof. Circular portion 14*a* has in the center an engagement hole 14*c* in which the outer peripheral surface of crank cam 5 is engaged rotatably, whereas extension 14*b* has a pin hole 14*d* in which pin 24 is engaged rotatably.

Link rod 15 is formed integrally by press working. Link rod 15 has a roughly C-shaped cross section, and is bent inward roughly like a letter L for a size reduction. First and second ends 15*a*, 15*b* of link rod 15 have pin holes formed therethrough. By pins 28, 29 arranged through the pin hole of left VO cam 7 and pin hole 20*f* of second arm 20, which correspond to the pin holes of first and second ends 15*a*, 15*b*, swelling 20*e* of second arm 20 of rocker arm 13 and cam nose 7*b* of left VO cam 7 are rotatably coupled to first and second ends 15*a*, 15*b* of link rod 15.

As shown in FIG. 3, flanges or engagement portions 28*a*, 29*a* are integrated with one ends of pins 28, 29 to engage with the edge of the pin holes of first and second ends 15*a*, 15*b* of link rod 15 so as to restrict disengagement of pins 28, 29 from the pin holes.

Control mechanism 9 includes: (a) control shaft 17 that is disposed above driving shaft 3, (b) control cam 18 that is integrally fixed on the outer periphery of control shaft 17 to form a rocking fulcrum of rocker arm 13, and (c) an actuator, not shown, for rotating control shaft 17.

Control shaft 17, which is disposed parallel to driving shaft 3 in the engine longitudinal direction, is rotatably supported on a bracket arranged at the upper end of a bearing, not shown. Control cam 18, which is shaped cylindrically, has an axis offset with respect to an axis of control shaft 17 by an amount of its thick portion.

With respect to FIG. 1, an oil passage 30 is axially formed through control shaft 17 to communicate with an oil gallery, not shown. An oil feed hole 31 and an oil hole 32 are radially formed through control cam 18 and protrusion 23 to communicate with oil passage 30. An oil passage 33 is formed in the inside face of second arm 20, which abuts on first arm 19, to communicate with oil hole 32. Oil passage 33, which extends to cross radially bolt hole 20*c*, has a lower-end opening 33*a* arranged on the side of swelling 20*e*.

The actuator comprises an electric motor fixed at the rear end of cylinder head 1 and screw transmission means or device for transmitting torque of the electric motor to control shaft 17.

The electric motor, which includes a proportional-type DC motor, is driven in accordance with a control signal out of an electronic control unit (ECU), not shown, for determining engine operating conditions. The ECU determines actual engine operating conditions through computing or the like by carrying-out feedback of detection signals out of various sensors such as: (a) a crank-angle sensor for sensing engine speed, (b) air-flow meter for detecting an intake air amount, (c) a coolant-temperature sensor for sensing an engine coolant temperature, and (d) a potentiometer for detecting a rotated position of control shaft 17, providing a control signal to the electric motor.

Operation of the first embodiment is described below. In the engine low-rotation range, for example, the electric motor is driven in accordance with a control signal out of the ECU to provide torque to the screw transmission means for rotation. With this, control shaft 17 is rotated in one direction by a predetermined amount. Then, control cam 18 is also rotated in the same direction to have the axis rotated about the axis of control shaft 17 in the same radius, having the thick portion moved upward with respect to driving shaft 3. Thus, a pivotal point of second arm 20 of rocker arm 13 and link rod 15 is moved upward with respect to driving shaft 3, so that each VO cam 7 has cam nose 7*b* forcedly pulled up through link rod 15.

Then, crank cam 5 is rotated to push up first arm 19 of rocker arm 13 through crank arm 14, the valve lift of which is transmitted to VO cam 7 and valve lifter 6, having a sufficiently small amount.

Therefore, in the engine low-rotation range, the valve lift becomes minimum, thereby providing delayed opening timing of intake valve 2, and reducing overlap between intake and exhaust valves. This results in achievement of enhanced fuel consumption and stable engine rotation.

When the engine falls in the engine high-rotation range, the electric motor is rotated in the reverse direction in accordance with a control signal out of the ECU to rotate the screw transmission means in the same direction. With this, control shaft 17 rotates control cam 18 in another direction to have the axis moved downward. Thus, rocker arm 13 in its entirety is moved in the direction of driving shaft 3, so that second arm 20 pushes down cam nose 7*b* of VO cam 7 through link rod 15 to rotate counterclockwise VO cam 7 in its entirety by a predetermined amount.

With VO cam 7, therefore, the contact position of cam face 7*a* with respect to the top face of valve lifter 6 is moved to cam nose 7*b* or the lift portion. Then, during opening operation of intake valve 2, crank cam 5 is rotated to push up second arm 20 of rocker arm 13 through crank arm 14, the valve lift of which is transmitted to valve lifter 6, having a sufficiently great amount.

Therefore, in the engine high-rotation range, the valve lift becomes maximums, thereby providing advanced opening timing and delayed closing timing of intake valve 2. This results in enhancement in intake charging efficiency, thereby achieving sufficient engine output.

In the first embodiment, when adjusting a variation or difference in valve lift between cylinders during assembling of various component parts of the VA apparatus, the component parts such as driving shaft 3 and transmission mechanism 8 are assembled to cylinder head 1 in advance through the bearings. With rocker arm 13, first and second arms 19, 20 are swingable relative to each other through large-diameter bolt holes 20*c*, 20*d*, so that, in the state that reference pin 25 abuts on contact face 27 by opening first and second arms 19, 20 maximally, arms 19, 20 are temporarily coupled/fixed by bolts 21, 22. With this, the reference lift is set.

Then, with the component parts positioned in the state of minimum lift control, the valve lift is checked between cylinders during minimum lift.

When the result of measurement shows occurrence of a difference in valve lift, a thickness gage serving as an adjusting member, i.e. the thickness of a shim, is determined using a calculation program for measurement, selecting a shim corresponding to the difference.

Then, bolts 21, 22 tightened temporarily are slightly loosened to insert the selected shim between reference pin 25 and contact face 27 from the outside.

Subsequently, driving shaft 3 is rotated to put intake valves 2 in the lift state to check whether or not the valve lift is at an appropriate amount. If the valve lift is at an appropriate amount, bolts 21, 22 are tightened again to couple and fix first and second arms 19, 20 securely. Then, the shim, which becomes unnecessary, is withdrawn between reference pin 25 and contact face 27.

Finally it is checked that the valve lift is at an appropriate amount, terminating difference adjusting operation.

As described above, in the first embodiment, with various component parts assembled to cylinder head 1, a difference in valve lift between cylinders can readily be adjusted through relative oscillation between first and second arms 19, 20. This results in not only improved efficiency of adjusting operation of the valve lift, but also enhanced accuracy of adjustment thereof.

Further, as reference pin 25 and contact face 27 are arranged between first and second arms 19, 20, the reference lift of intake valves 2 can be set in advance, to adjust a difference in valve lift. This allows more accurate measurement of the difference.

Still further, as first and second arms 19, 20 are coupled/fixed by bolts 21, 22 with a shim held between reference pin 25 and contact face 27, a difference in valve lift can surely be prevented from occurring during coupling/fixing operation.

Furthermore, as the reference setting member includes reference pin 25, it can be formed relatively easily and accurately. This ease and accuracy of formation facilitates an increase in accuracy of a contact position between reference pin 25 and contact face 27.

Further, with respect to FIG. 1, lubricating oil flowing from the oil gallery to oil passage 30 is introduced into oil passage 33 through oil feed hole 31 and oil hole 32. Flowing therefrom to lower-end opening 33*a* via bolt hole 20*c*, then running along the outer face of swelling 20*e* as shown by arrows, lubricating oil is supplied between the pin holes of first end 15*a* of link rod 15 and second arm 20 and pin 28. This enhances lubrication performance between the pin holes and pin 28.

Still further, first arm 19 has sufficiently large width W, thereby providing increased strength, and resulting in a realization of sufficient resistance to the great torque transmitted from crank cam 5 through crank arm 14.

With respect to FIGS. 6–10, there is shown second embodiment of the present invention which is substantially the same as the first embodiment except that the route of lubricating oil is changed slightly.

Specifically, making a modification to the oil passage groove for communicating with oil hole 32 of protrusion 23, a linear oil passage hole 34 is formed through second arm 20 and swelling 20*e* via pin hole 20*f*.

Therefore, lubricating oil is directly supplied between pin hole 20*f* and the pin hole of link rod 15 (and, therefore, the pin 28), thereby resulting in further enhancement in lubricating performance on the inner peripheral surface of pin hole 20*f* and the like.

Figure 11:
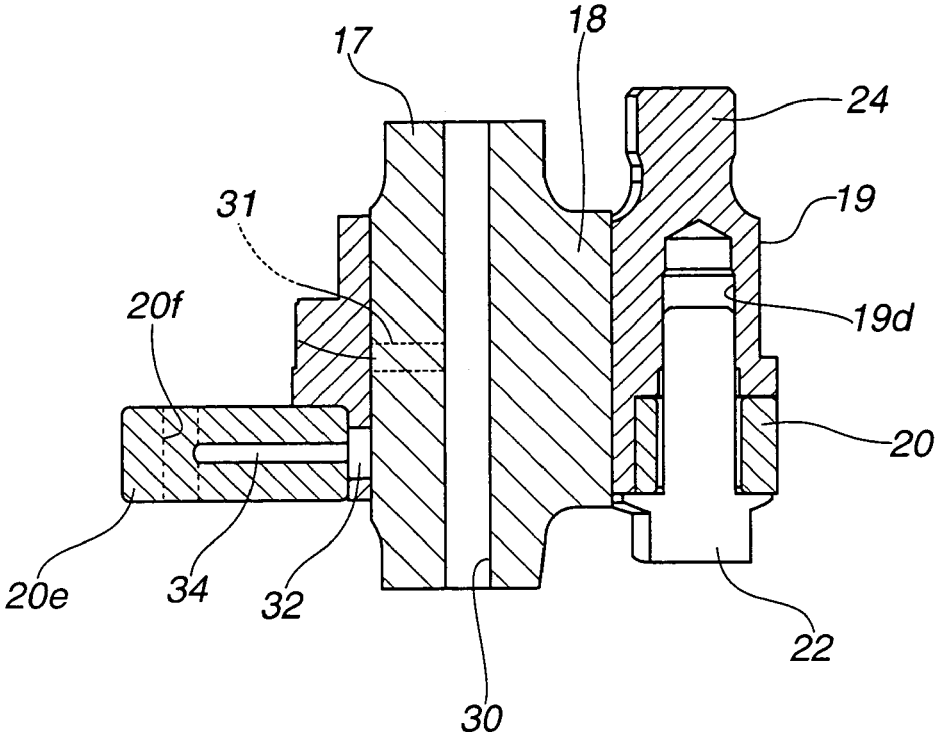
FIG. 11 is a view similar to FIG. 10, showing a third embodiment of the present invention.
Figure 12:
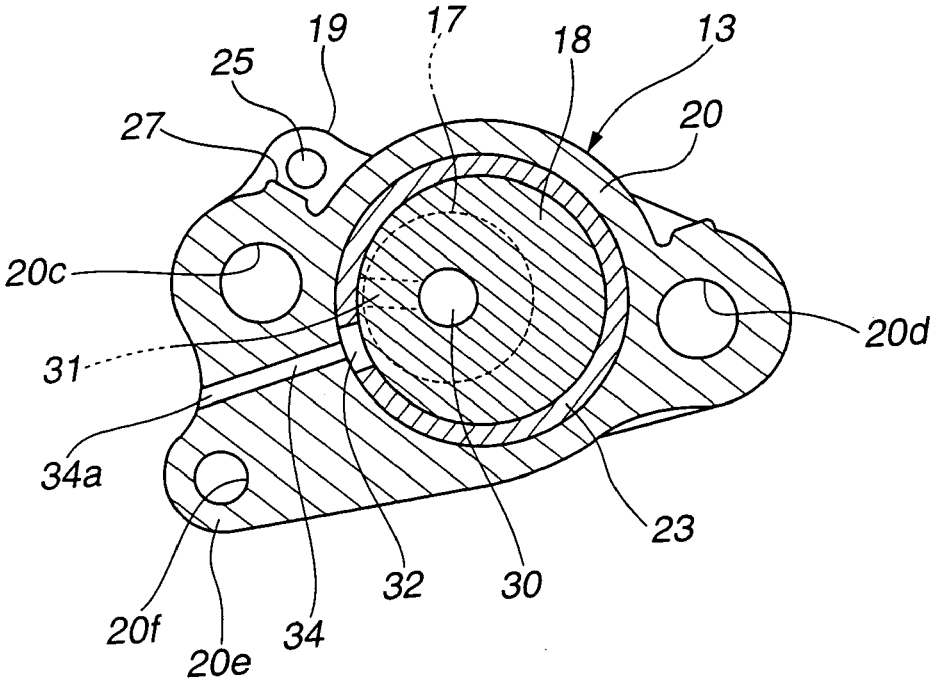
FIG. 12 is a view similar to FIG. 11, showing the rocker arm in FIG. 10.

With respect to FIGS. 11 and 12, there is shown third embodiment of the present invention, which is substantially the same as the second embodiment, except that oil passage hole 34 is formed to open to the upper end of swelling 20*e*, without passing through pin hole 20*f*. Flowing out of an one-end opening 34*a* of oil passage hole 34 and running downward along the outer face of swelling 20*e*, lubricating oil is directly supplied to pin hole 20*f*. Therefore, the third embodiment not only enhances lubrication around pin hole 20*f* in the same way as the above embodiments, but also facilitates the formation of oil passage hole 34, due to the possibility of drilling straight into the swelling 20*e* only.

Figure 13:
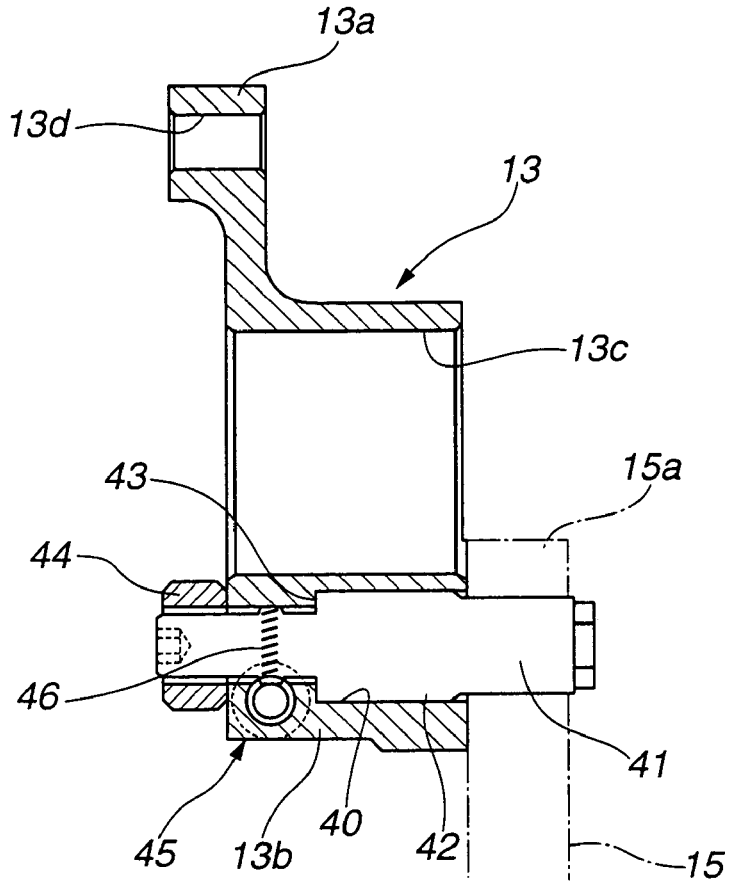
FIG. 13 is a view similar to FIG. 12, showing another example of a lift adjusting mechanism.
Figure 14:
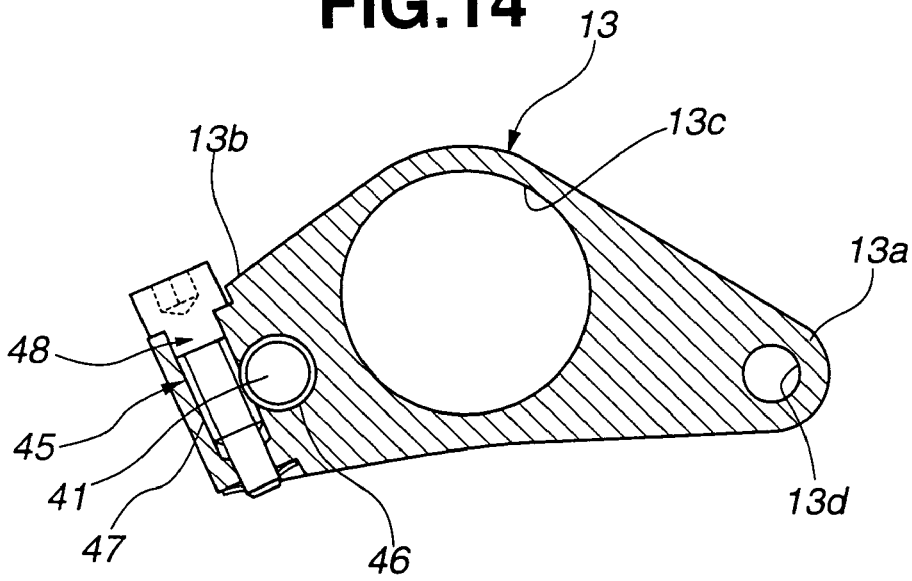
FIG. 14 is a view similar to FIG. 12, showing the lift adjusting mechanism in FIG. 13.

With respect to FIGS. 13 and 14, there is shown an example of a lift adjusting mechanism. One-piece rocker arm 13 has a support hole 13*c* formed roughly in the center to slidably receive control cam 18. First end (or arm) 13*a* is formed with a pin hole 13*d* to engage with a pin for rotatably coupling first end 13*a* to extension 14*b* of crank arm 14, whereas second end (or arm) 13*b* is formed with a support hole 40 for rotatably receiving a connecting rod 41 for linking second end 13*b* to link rod 15.

Integrated with the outer periphery of connecting rod 41 is an eccentric cam 42 which synchronously rotates in support hole 40. Eccentric cam 42 has: (a) an inner peripheral surface that is close to an end and that is formed with a small-diameter stepped portion 43, and (b) an outer peripheral surface that is closer to the end and that is formed with an external thread, which has an outer end with which a lock nut 44 is engaged.

Eccentric cam 42 is adjusted in rotated position by an adjusting mechanism 45 through connecting rod 41. Adjusting mechanism 45 includes: (a) connecting rod 41, which has a wheel threaded portion 46 formed in the outer peripheral surface of the end, and (b) an adjusting screw shank 48 that is rotatably arranged through second arm 13*b* of rocker arm 13 from above and that has a worm threaded portion 47. The worm threaded portions 47 is formed in the outer peripheral surface and meshed with wheel threaded portion 46. Moreover, the worm threaded portion 47 of adjusting screw shank 48 is meshed with wheel threaded portion 46 of connecting rod 41 in an orthogonal way.

Eccentric cam 42 is adjusted in rotated position by an adjusting mechanism 45 through connecting rod 45. Adjusting mechanism 45 comprises connecting rod 41 having a wheel threaded portion 46 formed in the outer peripheral surface of the end, and an adjusting screw shank 48 rotatably arranged through second arm 13*b* of rocker arm 13 from above and having a worm threaded portion 47 formed in the outer peripheral surface and meshed with wheel threaded portion 46. Worm threaded portion 47 of adjusting screw shank 48 is meshed with wheel threaded portion 46 of connecting rod 41 in an orthogonal way.

In this example, therefore, when adjusting the valve lift between cylinders, the component parts are assembled to cylinder head 1 at the upper end, and then a difference in valve lift is checked by a predetermined method.

When the difference occurs between cylinders, adjusting screw shank 48 is rotated, in accordance with the difference, in the right or left direction little by little by a predetermined jig such as a driver. At that time, lock nut 44 is in the released state.

Resultant torque is transmitted from worm threaded portion 47 to wheel threaded portion 46, thereby rotating eccentric cam 42 in support hole 40 through connecting rod 41. With this, the length between second arm 13*b* of rocker arm 13 and first end 15*a* of link rod 15 changed in accordance with the rotated position of eccentric cam 42, thereby absorbing a difference in valve lift. That is, the length of link rod 15 is changed substantially arbitrarily to adjust the difference appropriately.

Finally, lock nut 44 is tightened to lock free rotation of connecting rod 41. In such a way, adjusting operation is terminated very simply.

Therefore, this example contributes not only achieves adjustment of a difference in valve lift very easily, but also enables fine adjustment thereof due to the adjusting mechanism 45 serving as a reduction mechanism.

Further, this example contributes to simplification of the structure, thereby restraining manufacturing cost. Particularly, as worm threaded portion 47 is meshed with wheel threaded portion 46 in an orthogonal way, the size of the structure in its entirety can be reduced, thereby resulting in a size reduction of the apparatus.

As previously described, according to the present invention, when adjusting a difference in valve lift between cylinders while assembling various component parts to the cylinder head, the first and second arms of the rocker arm are put in advance in the free state or relatively swingable state. Then, in accordance with the difference, the first and second arms are swung relative to each other to adjust the difference, at which the arms are fixed by the fixing device.

Therefore, a difference in valve lift can be readily adjusted with the component parts assembled to the cylinder head.

This results in not only improved efficiency of adjusting operation of the valve lift, but also enhanced accuracy of adjustment thereof.

Further, according to the present invention, the reference setting member is arranged between the first and second arms, thereby allowing setting of a reference lift of the engine valve.

Still further, according to the present invention, engagement between the protrusion and the engagement portion secures coaxiality of the first and second arms, thereby achieving a relatively smooth swinging state of the arms. Moreover, the arms can be disposed coaxial with the support shaft, thereby also achieving a constantly smooth swinging state of the rocker arm in its entirety.

Still further, according to the present invention, though the first arm undergoes torque directly and thus may have great driving load, it has increased size in the width direction to enhance the strength thereof, thereby preventing a problem such as deflection even, when undergoing great driving load.

Furthermore, according to the present invention, the contact portion of another arm is formed in an inclined way, thereby facilitating insertion of an adjusting member such as a shim between the contact portion and the protrusion.

Further, according to the present invention, as the protrusion includes a reference pin, it can be formed relatively easily and accurately. This allows an increase in accuracy of a contact position between the reference pin and the contact portion.

Still further, according to the present invention, lubricating oil introduced from the oil passage to the oil holes can be supplied to the slide surfaces between the first and second arms and the link rod, for example, thereby resulting in enhanced lubrication performance of the slide surfaces.

Further, according to the present invention, when adjusting the valve lift between cylinders in the minimum lift area of the engine valve while assembling the component parts, the connecting rod is rotated little by little in one direction, for example, by the adjusting mechanism, which causes a synchronous rotation of the eccentric cam, thereby varying a pivotal point of the link rod. This allows fine adjustment of the lift of the engine valve.

Still further, according to the present invention, adjustment is carried out by rotation of the wheel threaded portion and the worm threaded portion, thereby allowing easy rotation of the connecting rod and finer adjustment of a pivotal point of the link rod.

Still further, according to the present invention, orthogonal meshing allows simplification of the structure in its entirety and reduction in size thereof.

Furthermore, according to the present invention, greater effect of the invention is produced, particularly, in the VA apparatus wherein the lift of the engine valve is controlled variably.

Further, according to the present invention, greater effect of the invention is produced, particularly, at minute valve lift, in view of occurrence of grave influence of a difference in valve lift between cylinders at minute valve lift.

Furthermore, according to the present invention, greater effect of the present invention is produced, particularly, in view of the fact that occurrence of a difference in minute valve lift renders lift control inaccurate.

Having described the present invention in connection with the illustrative embodiments, it is noted that present invention is not limited thereto, and various changes and modifications can be made without departing from the scope of the present invention. By way of example, the reference setting member may include a protrusion integrated with one of first and second arms 19, 20 in place of reference pin 25. Moreover, the adjusting member may include a reference pin 25 that is formed to be retractable in the arm in place of a shim, wherein one of reference pins 25, which has different head outer diameter, is selectively used for adjustment.

Further, the present invention can be applied not only to the intake valve, but also to an exhaust valve or both of the intake and exhaust valves.

The entire teachings of Japanese Patent Application P2003-205949 are hereby incorporated by reference.

What is claimed is:

1. A valve actuation (VA) apparatus for an internal combustion engine, comprising:

a shaft;

a rocker arm coaxially swingably supported on the shaft, the rocker arm being swung by a torque transmitted from the engine to operate an engine valve, the rocker arm comprising a first arm to which the torque is transmitted and a second arm for operating the engine valve, the first and second arms being separate and distinct from each other, the first and second arms being swingable relative to each other; and a fixing device that fixes the first and second arms in a predetermined relative angle position, wherein the first and second arms have faces opposed to each other, wherein one of the faces is formed with a cylindrical protrusion arranged at an edge of a hole for receiving the shaft, and wherein the other face is formed with an engagement portion in which the protrusion is swingably engaged.

2. The VA apparatus as claimed in claim 1, further comprising a reference setting member arranged between the first and second arms, the reference setting member defining a reference position of a relative swinging angle of the first and second arms.

3. The VA apparatus as claimed in claim 2, wherein the reference setting member comprises a protrusion that protrudes from one of the first and second arms to another arm, wherein a side edge of the protrusion abuts, from a swinging direction of the first and second arms, on a contact portion arranged at a predetermined position of the other of the first and second arms to restrict a swinging portion of the first and second arms in one direction, and wherein the contact portion of the other of the first and second arms has an outer, inclined edge.

4. The VA apparatus as claimed in claim 3, wherein the protrusion comprises a pin fixed to one of the first and second arms.

5. The VA apparatus as claimed in claim 1, wherein the first arm has a width larger than a width of the second arm in an axial direction of the shaft.

6. The VA apparatus as claimed in claim 1, further comprising an oil passage axially formed through the shaft and oil holes formed in the first and second arms, the oil holes communicating with the oil passage and opening to a lower side in a direction of gravitation.

7. A valve actuation (VA) apparatus for an internal combustion engine, comprising:

a shaft;

a rocker arm coaxially swingably supported on the shaft, the rocker arm being swung by a torque transmitted from the engine to operate an engine valve, the rocker arm comprising a first arm to which the torque is transmitted and a second arm for operating the engine valve, the first and second arms being separate and distinct from each other, the first and second arms being swingable relative to each other;

a fixing device that fixes the first and second arms in a predetermined relative angle position; and an alteration mechanism that changes a lift of the engine valve in accordance with engine operating conditions.

8. The VA apparatus as claimed in claim 7, wherein the alteration mechanism controls the lift of the engine valve to a minute value.

9. The VA apparatus as claimed in claim 7, wherein the alteration mechanism controls the lift of the engine valve continuously.

10. The VA apparatus as claimed in claim 7, wherein the alteration mechanism comprises:

a driving shaft rotated by the engine, a crank cam fixed on an outer periphery of the driving shaft, and the rocker arm having one end linked to the crank cam through a crank arm, wherein the rocker arm is swingably supported on an outer peripheral surface of an eccentric control cam fixed on an outer periphery of a control shaft, wherein the rocker arm has another end linked to a valve operating (VO) cam for opening and closing the engine valve through a link rod, wherein the VO cam is swingably supported on the driving shaft, and wherein the control shaft and the control cam are controlled in rotation in accordance with the engine operating conditions to vary a rocking fulcrum of the rocker arm, thereby varying a slide position of the VO cam with respect to the engine valve, and thus changing the lift of the engine valve.

11. A method of adjusting a lift of a valve actuation (VA) apparatus comprising a rocker arm swung by a torque transmitted from the engine to operate an engine valve, the rocker arm comprising a first arm to which the torque is transmitted and a second arm for operating the engine valve, the first and second arms being separate and distinct from each other, the first and second arms being swingable relative to each other, and a fixing device which fixes the first and second arms in a predetermined relative angle position, the method comprising:

determining a relative reference angle position of the first and second arms by a reference setting member for defining a relative reference position of the first and second arms;

fixing temporarily the first and second arms by the fixing device;

measuring a difference in lift of the engine valve between cylinders with the first and second arms fixed;

selecting, in accordance with the measured difference, an adjusting member for adjusting the difference to an optimum value;

interposing the adjusting member between the reference setting member and one of the first and second arms with fixing of the first and second arms by the fixing device released; and fixing definitively the first and second arms by the fixing device with the adjusting member interposed between the reference setting member and one of the first and second arms.

12. The method as claimed in claim 11, wherein the VA apparatus comprises:

an alteration mechanism comprising:

a driving shaft rotated by the engine, a crank cam fixed on an outer periphery of the driving shaft, and the rocker arm having one end linked to the crank cam through a crank arm, wherein the rocker arm is swingably supported on an outer peripheral surface of an eccentric control cam fixed on an outer periphery of a control shaft, wherein the rocker arm has another end linked to a valve operating (VO) cam for opening and closing the engine valve through a link rod, wherein the VO cam is swingably supported on the driving shaft, and wherein the control shaft and the control cam are controlled in rotation in accordance with the engine operating conditions to vary a rocking fulcrum of the rocker arm, thereby varying a slide position of the VO cam with respect to the engine valve, and thus changing the lift of the engine valve.

13. A valve actuation (VA) apparatus for an internal combustion engine, comprising:

a shaft;

a rocker arm swingably supported on the shaft, the rocker arm having a first end to which a torque is transmitted from the engine to swing the rocker arm and a second end for operating an engine valve, wherein the second end is rotatably coupled to a link rod through a connecting rod;

an eccentric cam provided to the connecting rod, the eccentric cam changing a pivotal point of the link rod with respect to the second end of the rocker arm through rotation of the connecting rod; and an adjusting mechanism that adjusts a rotated position of the eccentric cam by rotating the connecting rod through a reduction mechanism.

14. A valve actuation (VA) apparatus for an internal combustion engine, comprising:

a shaft;

a rocker arm swingably supported on the shaft, the rocker arm having a first end to which a torque is transmitted from the engine to swing the rocker arm and a second end for operating an engine valve, wherein the second end is rotatably coupled to a link rod through a connecting rod;

an eccentric cam provided to the connecting rod, the eccentric cam changing a pivotal point of the link rod with respect to the second end of the rocker arm through rotation of the connecting rod; and an adjusting mechanism that adjusts a rotated position of the eccentric cam through the connecting rod, wherein the adjusting mechanism comprises the connecting rod having a wheel threaded portion formed in an outer peripheral surface and an adjusting screw shank having a worm threaded portion meshed with the wheel threaded portion for torque transmission.

15. The VA apparatus as claimed in claim 14, wherein the connecting rod and the adjusting screw shank are meshed with each other in an orthogonal way.

16. The VA apparatus as claimed in claim 14, further comprising an alteration mechanism which changes a lift of the engine valve in accordance with engine operating conditions.

17. The VA apparatus as claimed in claim 16, wherein the alteration mechanism controls the lift of the engine valve to a minute value.

18. The VA apparatus as claimed in claim 16, wherein the alteration mechanism controls the lift of the engine valve continuously.

19. The VA apparatus as claimed in claim 16, wherein the alteration mechanism comprises:

a driving shaft rotated by the engine, a crank cam fixed on an outer periphery of the driving shaft, and the rocker arm having one end linked to the crank cam through a crank arm, wherein the rocker arm is swingably supported on an outer peripheral surface of an eccentric control cam fixed on an outer periphery of a control shaft, wherein the rocker arm has another end linked to a valve operating (VO) cam for opening and closing the engine valve through a link rod, wherein the VO cam is swingably supported on the driving shaft, and wherein the control shaft and the control cam are controlled in rotation in accordance with the engine operating conditions to vary a rocking fulcrum of the rocker arm, thereby varying a slide position of the VO cam with respect to the engine valve, and thus changing the lift of the engine valve.

* * * * *